US005988969A

United States Patent [19]

Maes

[11] Patent Number: 5,988,969

[45] Date of Patent: Nov. 23, 1999

[54] DEVICE FOR LIMITING THE FORCE EXERTED ON AN ACTUATING MECHANISM

[75] Inventor: Dirk Maes, Lokeren, Belgium

[73] Assignees: Esselte N.V., Sint-Niklaas, Belgium; Attalus High Tech Industry SA, Athens, Greece

[21] Appl. No.: 09/045,709

[22] Filed: Mar. 23, 1998

[30] Foreign Application Priority Data

May 10, 1997 [EP] European Pat. Off. ..... 97107685

[51] Int. Cl.[6] ..... B42B 5/08

[52] U.S. Cl. ..... 412/38; 83/625

[58] Field of Search ..... 412/38, 22, 33; 83/625, 633, 634, 695, 620

[56] References Cited

U.S. PATENT DOCUMENTS

| | | | |
|---|---|---|---|
| 2,619,172 | 11/1952 | Flittner | 412/40 |
| 4,872,796 | 10/1989 | Hsieh et al. . | |
| 5,255,587 | 10/1993 | Eichenberg et al. | 83/628 |
| 5,273,387 | 12/1993 | Groswith, III et al. | 412/40 |
| 5,632,188 | 5/1997 | Karlis | 83/167 |
| 5,778,748 | 7/1998 | Beijen | 83/529 |

FOREIGN PATENT DOCUMENTS 2 098 115 3/1972 France .

OTHER PUBLICATIONS

Akademischen Verein Hutte: "Hutte des Ingenieurs taschenbuch; maschinenbau, teil A" 1954, Verlag Von Wilhelm Ernst & Sohn, Berlin XP002041597—seite 122; Abbildung 28.

*Primary Examiner*—Andrea L. Pitts
*Assistant Examiner*—Adesh Bhargava
*Attorney, Agent, or Firm*—Jones, Tullar & Cooper, P.C.

[57] ABSTRACT

The present invention is directed to a device for limiting the force exerted on an actuating mechanism for a binding device and/or a perforating/punching device, with the actuating mechanism being comprised of a rotary shaft coupled to the corresponding movable part of the binding and/or perforating/punching device, such that a rotary motion of the shaft is converted into a translational motion of the corresponding movable part of the binding and/or perforating device. There; is provided in the actuating mechanism a coupling mechanism which performs a decoupling function automatically when the force exerted on the actuating mechanism exceeds a maximum permissible value.

5 Claims, 3 Drawing Sheets

DEVICE FOR LIMITING THE FORCE EXERTED ON AN ACTUATING MECHANISM

BACKGROUND OF THE INVENTION TECHNICAL FIELD

This invention relates to a device for limiting the force exerted on an actuating mechanism for a binding device and/or a perforating/punching device, with the actuating mechanism being comprised of a rotary shaft coupled to a corresponding movable part of the binding and/or perforating/punching device, such that a rotary motion of the shaft is converted into a translational motion of the corresponding movable part of the binding and/or perforating device.

BACKGROUND ART

A number of methods are known in the art which aim to produce a permanently bound document from loose leaves. These methods are based on the principle of connecting the leaves on one side either by means of a thermal adhesive—referred to as thermal binding methods—or by means of mechanical binding elements such as comb binding elements, wire binding elements or channel binding elements. Where comb binding elements or wire binding elements are utilized, it is first necessary for the loose leaves to be perforated. It is therefore conventional practice to integrate a perforating/punching mechanism in comb or wire binding devices. A wire binding device is known, for example, from U.S. Pat. No. 4,482,279. A comb binding device is described in U.S. Pat. No. 4,613,266. A device referred to as channel binder is described in U.S. Pat. No. 5,226,771. Finally, an electric wire comb binding machine is known from U.S. Pat. No. 5,452,980.

In comb binding and wire binding devices having an integrated perforating/punching mechanism, relatively high forces are applied to the actuating mechanism during the perforating/punching operation. Every now and then it happens that the maximum load-carrying capability of the parts subjected to load is exceeded because the operating personnel exceeds, for example, the predetermined maximum number of sheets that can be perforated/punched in a single operation, or because cardboard or plastic sheets are perforated/punched instead of paper sheets. To obviate the first mentioned risk, a measuring unit may be provided on the device indicating to the operator the maximum permissible thickness of a paper stack to be perforated/punched. Such an arrangement does not, however, eliminate the second risk that materials other than paper but having the permissible thickness are perforated/punched in the perforating/punching mechanism. When the load exerted on the actuating mechanism exceeds a maximum permissible value, deformation or fracture of the machine parts may result due to the excessive loads imposed on them.

The situation is similar if in a channel binding device channel elements are used which are unsuitable for the corresponding channel binding device. In this event, too, parts of the device may be destroyed as a result of overloading.

SUMMARY OF THE INVENTION

It is an object of the present invention to provide a device which protects parts of a binding device and/or a perforating/punching device with limited load-carrying capability against destruction.

This object is accomplished by providing in the actuating mechanism a coupling mechanism which performs a decoupling function automatically when the force exerted on the actuating mechanism exceeds a maximum permissible value.

By virtue of the solution provide by the present invention, better judgment of the operating personnel is no longer necessary in the use of the binding and/or perforating/punching device. Nor does the solution provided by the present invention seek to optimize the materials for the loaded parts such that they are capable of withstanding even the highest loads; such a solution would be far too costly.

Rather, the approach taken by the solution provided by the present invention differs from prior known possibilities as follows: It integrates into the actuating mechanism a coupling mechanism which decouples automatically when the load exceeds a maximum permissible value. Accordingly, when an overload occurs, it is no longer necessary to replace essential and generally rather expensive and difficult-to-install machine parts, but in the worst case only an inexpensive breaking piece which can be replaced by the operating personnel.

Because the coupling mechanism performs the decoupling function each time the operating personnel exceeds the maximum permissible load which the perforating/punching device is designed to carry, the solution provided by the present invention has an added learning effect.

According to an advantageous further aspect of the device of the present invention, the actuating mechanism for the binding and/or perforating/punching device includes a lever which is connected with the rotary shaft.

A further possibility makes provision for operating the binding and/or perforating/punching device electrically. In this event, the actuating mechanism for the binding and/or perforating/punching device includes a motor driving the rotary shaft.

According to an advantageous embodiment of the device of the present invention, the coupling mechanism is configured such as to be destroyed when the maximum permissible force is exceeded. In particular, the coupling mechanism comprises a pin which establishes the connection between the motor or the lever and the rotary shaft and which breaks when a maximum permissible force is exceeded. If this happens, therefore, the coupling mechanism is in need of replacement.

The operation of replacing the destroyed coupling mechanism is avoided by the following alternative embodiment of the device of the present invention. It involves a non-rigid bearing structure arranged between the motor or the lever and the rotary shaft. In particular, the coupling mechanism is configured such as to disengage itself from the non-rigid bearing structure when a maximum permissible force is exceeded.

In this connection, it has proven to be particularly suitable to use a coupling mechanism that is comprised of the following parts: a recess in the end area of the rotary shaft acted upon by the motor or the lever; a cavity provided in the connecting piece between the motor and the rotary shaft or between the lever and the rotary shaft for receiving a spring; a contact element which effects the coupling between the rotary shaft and the motor or the lever and which on proper actuation of the binding and/or perforating device engages within the recess and which, when the force exerted on the actuating mechanism exceeds a maximum permissible value, becomes disengaged from the recess, as a result of which the motor or the lever is decoupled from the rotary shaft.

According to an advantageous further aspect of the device of the present invention, it is proposed that the recess be a groove-shaped depression and that the contact element be a ball.

The present invention will be described in more detail in the following with reference to the accompanying drawings. In the drawings,

DESCRIPTIONS OF THE PREFERRED EMBODIMENTS

Figure 1:
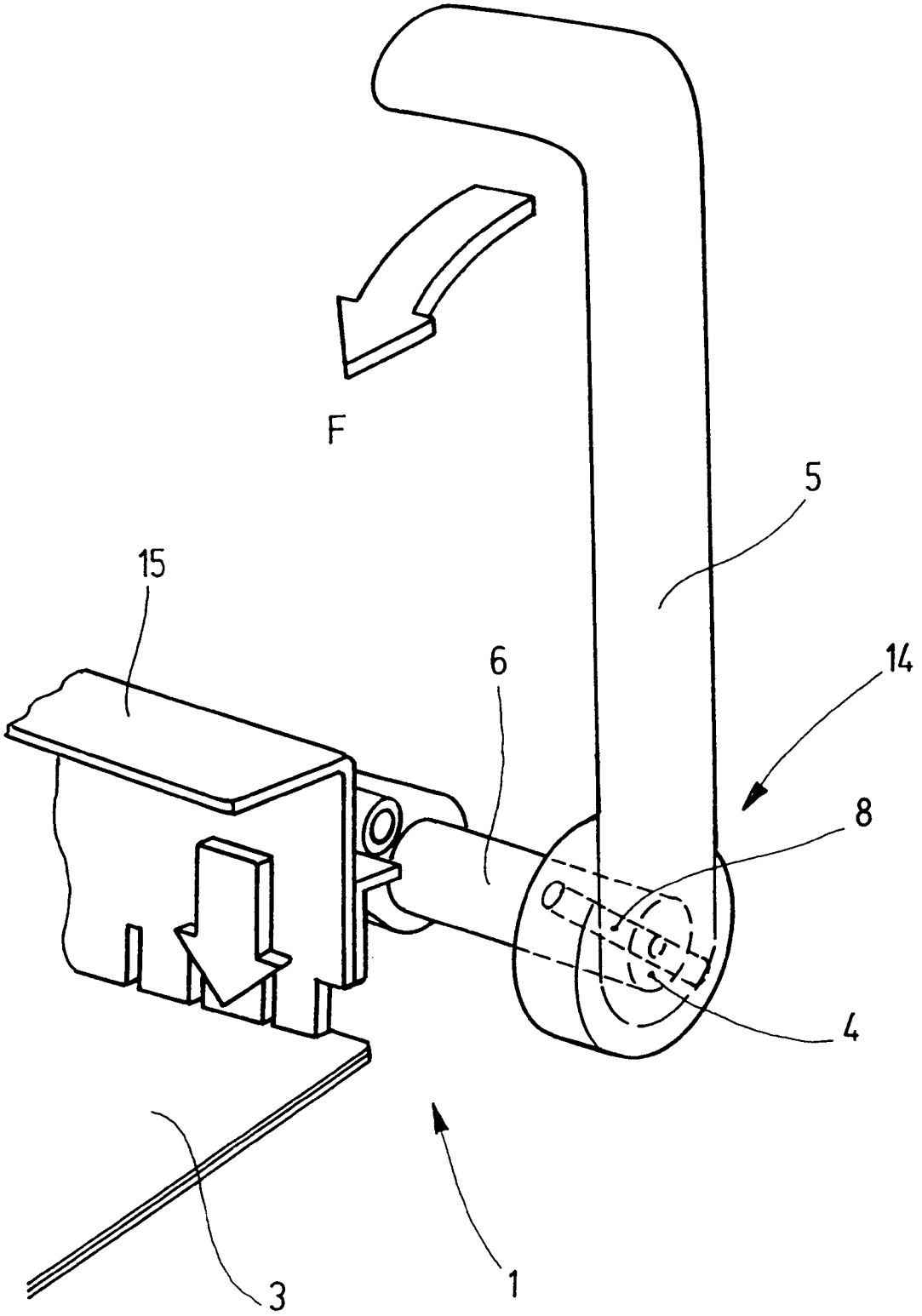
FIG. 1 is a perspective partial view of a first embodiment of the device of the present invention utilized in a perforating/punching device.

Referring now to FIG. 1 of the drawings, there is shown a perspective partial view of a first embodiment of the device of the present invention utilized in a perforating/punching device 1. Operation of the lever 5 in the direction of the arrow F causes the movable part 15 to be moved in the direction of the paper stack 3 and to perforate a hole pattern in the margin region of the paper stack 3. In the embodiment shown, the movable part 15 is a metal plate from which individual blades are cut out by stamping. To maintain the manufacturing cost of the perforating/punching device as low as possible, the lever 5, the rotary shaft 6 and the perforating plate 15 are designed to carry only specified loads not exceeding an upper limit value. To preclude destruction of the elements under excessive loads, a coupling mechanism 4 is provided between the lever 5 and the rotary shaft 6. In the embodiment shown, this coupling mechanism is comprised of a pin 8 configured as a breaking piece. This is accomplished either by selecting an appropriate material or by suitably treating the pin 8 mechanically (for example, by providing it with a groove or a notch).

Figure 2:
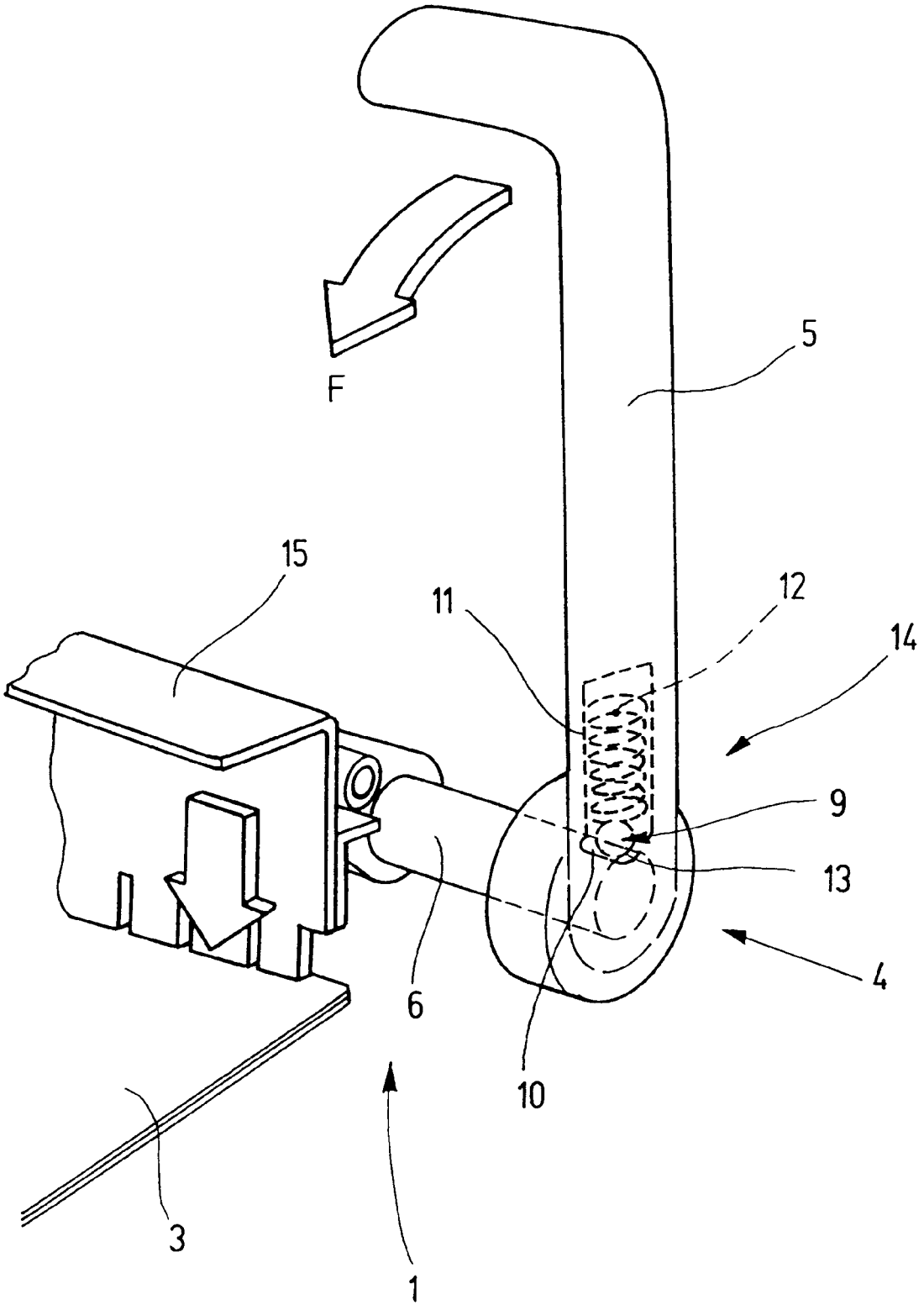
FIG. 2 is a perspective partial view of a second embodiment of the device of the present invention utilized in a perforating/punching device.

FIG. 2 shows a perspective partial view of a second embodiment of the device of the present invention utilized in a perforating/punching device 1. In this embodiment, the device of the present invention is comprised of a mechanism which performs a decoupling function when overloaded. This coupling mechanism 4 is of the self-healing type. It comprises a non-rigid bearing structure 9 having a ball 13 held by a spring 12 in a correspondingly shaped recess 10 of the rotary shaft 6. The spring 12 is arranged in the cavity 11 of the lever 5. When the force exerted on the actuating mechanism 14 exceeds the maximum permissible value which the individual parts of the device are designed to be able to carry, the friction force of the ball 13 within the recess 10 is overcome. The non-rigid bearing structure of the coupling mechanism 4 decouples, thereby interrupting the perforating/punching operation. As soon as the force ceases to act on the lever 5, the coupling mechanism 4 returns to its initial position by pushing the lever 5 back into its starting position.

Figure 3:
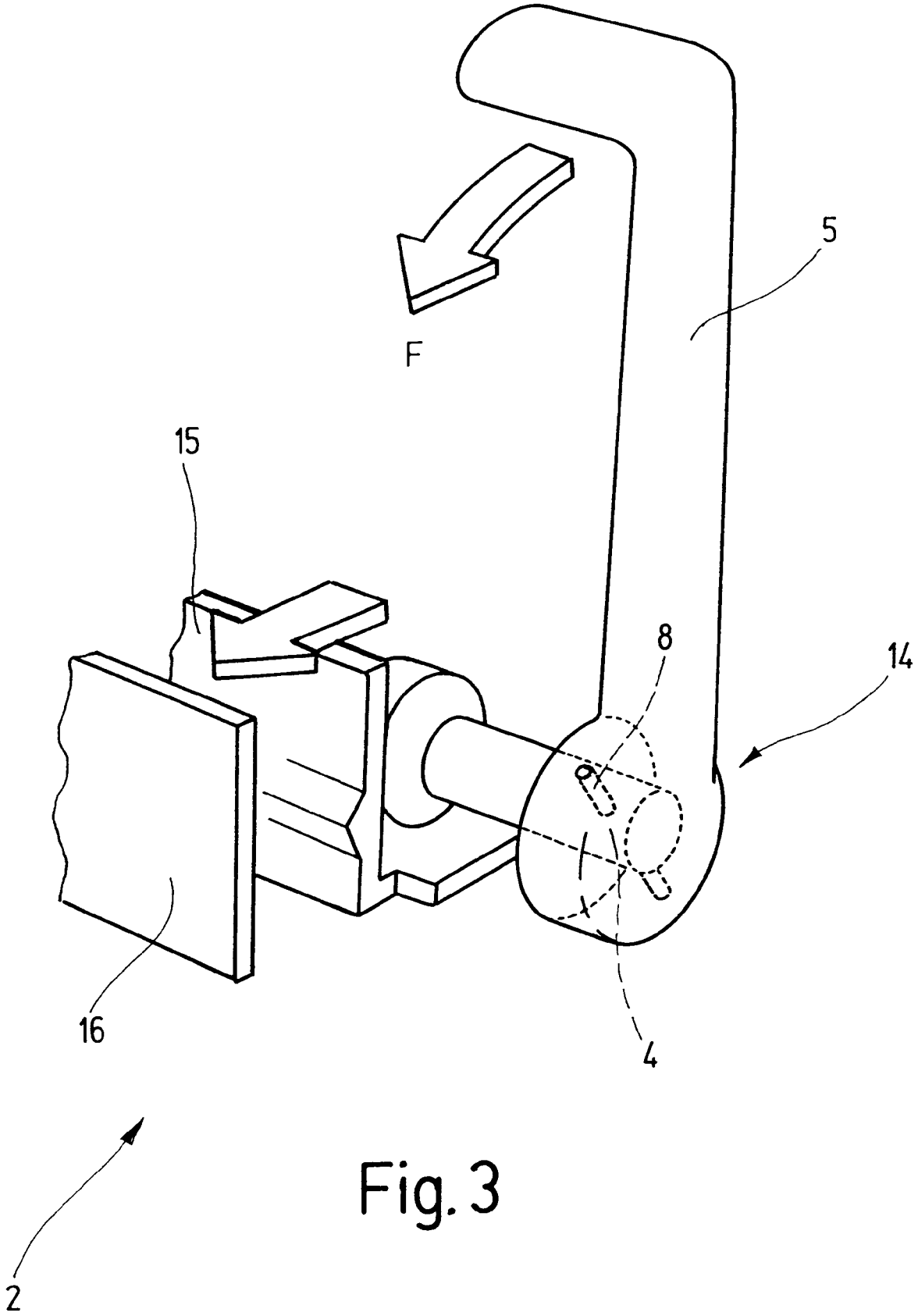
FIG. 3 is a perspective partial view of an embodiment of the device of the present invention utilized in a channel binding device.

FIG. 3 illustrates a perspective partial view of an embodiment of the device of the present invention utilized in a channel binding device 2. The sole difference to FIG. 1 is that the movable part 15 executes a horizontal movement, and not a vertical movement. In each embodiment, a motor 7 may be provided to drive the rotary shaft 6.

What is claimed is:

1. A device for limiting the force exerted on an actuating mechanism for a binding, perforating, or punching device, the bind, perforating, or punching device having a movable part, the device comprising:

the actuating mechanism including a rotary shaft coupled to the movable part such that a rotary motion of said rotary shaft is converted into a translational motion of the movable part; and a coupling mechanism which automatically decouples said actuating mechanism from the movable part when the force exerted on said actuating mechanism exceeds a maximum permissible value, wherein said coupling mechanism is configured to be destroyed when the maximum permissible force is exceeded.

2. The device as defined in claim 1, wherein said actuating mechanism includes a lever connected with said rotary shaft.

3. The device as defined in claim 1, wherein said actuating mechanism includes a motor which drives said rotary shaft.

4. The device as defined in claim 2, wherein said coupling mechanism comprises a pin situated between said lever and said rotary shaft, and wherein said pin breaks when the maximum permissible force is exceeded.

5. The device as defined in claim 3, wherein said coupling mechanism comprises a pin situated between said motor and said rotary shaft, and wherein said pin breaks when the maximum permissible force is exceeded.

* * * * *